US011654433B2

(12) United States Patent
Long et al.

(10) Patent No.: US 11,654,433 B2
(45) Date of Patent: May 23, 2023

(54) MICROFLUIDIC CHIP AND DRIVING METHOD THEREOF

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Feng Long, Beijing (CN); Zongze He, Beijing (CN); Xiuyun Chen, Beijing (CN); Yuxuan Chen, Beijing (CN); Yu Zhang, Beijing (CN); Pin Xiao, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 459 days.

(21) Appl. No.: 16/649,239

(22) PCT Filed: Sep. 30, 2019

(86) PCT No.: PCT/CN2019/109477

§ 371 (c)(1),
(2) Date: Mar. 20, 2020

(87) PCT Pub. No.: WO2020/073872

PCT Pub. Date: Apr. 16, 2020

(65) Prior Publication Data

US 2020/0254444 A1 Aug. 13, 2020

(30) Foreign Application Priority Data

Oct. 9, 2018 (CN) ..... 201811172575.6

(51) Int. Cl.
*B01L 3/00* (2006.01)

(52) U.S. Cl.
CPC ..... *B01L 3/50273* (2013.01); *B01L 3/502715* (2013.01); *B01L 3/502792* (2013.01);
(Continued)

(58) Field of Classification Search
CPC ..... B01L 3/50273; B01L 3/502715; B01L 3/502792; B01L 2200/06; B01L 2300/02;
(Continued)

(56) References Cited

U.S. PATENT DOCUMENTS 6,787,384 B2 9/2004 Okumura
2006/0210994 A1 9/2006 Joyce
(Continued)

FOREIGN PATENT DOCUMENTS

CN 1402033 A 3/2003
CN 105161042 A 12/2015
(Continued)

*Primary Examiner* — Christine T Mui
(74) *Attorney, Agent, or Firm* — Dilworth & Barrese, LLP.; Michael J. Musella, Esq.

(57) ABSTRACT

A microfluidic chip and a driving method thereof are provided. The microfluidic chip includes a base substrate, a driving circuit array, a first decoding circuit, and a second decoding circuit, the driving circuit array, the first decoding circuit, and the second decoding circuit are all integrated on the base substrate; the first decoding circuit is configured to generate and output a target scan driving signal to the driving circuit array; the second decoding circuit is configured to generate and output a target driving voltage signal to the driving circuit array; and the driving circuit array is configured to control an operation of a liquid droplet over the driving circuit array based on the target scan driving signal and the target driving voltage signal.

19 Claims, 7 Drawing Sheets

(52) U.S. Cl.
CPC ..... *B01L 2200/06* (2013.01); *B01L 2300/02* (2013.01); *B01L 2300/06* (2013.01); *B01L 2300/0645* (2013.01); *B01L 2400/0415* (2013.01); *B01L 2400/0475* (2013.01)

(58) Field of Classification Search
CPC ..... B01L 2300/06; B01L 2300/0645; B01L 2400/0415; B01L 2400/0475
USPC ..... 204/601
See application file for complete search history.

(56) References Cited

U.S. PATENT DOCUMENTS

| | | | |
|---|---|---|---|
| 2012/0249608 | A1 | 10/2012 | Ikari et al. |
| 2020/0055050 | A1 | 2/2020 | Geng et al. |
| 2020/0254444 | A1 | 8/2020 | Long et al. |

FOREIGN PATENT DOCUMENTS

| | | | |
|---|---|---|---|
| CN | 108355728 | A | 8/2018 |
| CN | 109126917 | A | 1/2019 |
| WO | 200114064 | A1 | 1/2001 |
| WO | 2008117209 | A1 | 10/2008 |

MICROFLUIDIC CHIP AND DRIVING METHOD THEREOF

The present application claims priority of Chinese Patent Application No. 201811172575.6, filed on Oct. 9, 2018, and for all purposes, the entire content disclosed by the Chinese patent application is incorporated herein by reference as part of the present application.

TECHNICAL FIELD

Embodiments of the present disclosure relate to a microfluidic chip and a driving method thereof.

BACKGROUND

Microfluidics is an emerging technology, and the microfluidics has great application prospects in fields, such as biology, chemistry, medicine, and the like. A microfluidic chip is a main platform for achieving the microfluidics. Basic operation units, such as sample preparation, reaction, separation, detection, and the like, in analysis processes of biological, chemical, and medical, can be integrated into a microfluidic chip with micron scale, the whole analysis process can be completed automatically on the microfluidic chip. There are hundreds or thousands of electrodes in the microfluidic chip, so it becomes difficult to control a certain electrode individually.

SUMMARY

At least one embodiment of the present disclosure provides a microfluidic chip, the microfluidic chip comprises: a base substrate, a driving circuit array, a first decoding circuit, and a second decoding circuit; the driving circuit array, the first decoding circuit, and the second decoding circuit are all integrated on the base substrate; the first decoding circuit is configured to generate and output a target scan driving signal to the driving circuit array; the second decoding circuit is configured to generate and output a target driving voltage signal to the driving circuit array; the driving circuit array comprises a plurality of driving circuits and is configured to control an operation of a liquid droplet over the driving circuit array based on the target scan driving signal and the target driving voltage signal; and a first terminal of each of the plurality of driving circuits is coupled to the first decoding circuit, and a second terminal of each of the plurality of driving circuits is coupled to the second decoding circuit.

For example, in the microfluidic chip provided by an embodiment of the present disclosure, each of the plurality of driving circuits comprises a transistor and a driving electrode, the first terminal of each of the plurality of driving circuits comprises a gate electrode of the transistor, the second terminal of each of the plurality of driving circuits comprises a first electrode of the transistor, and in each of the plurality of driving circuits, a second electrode of the transistor is connected to the driving electrode.

For example, in the microfluidic chip provided by an embodiment of the present disclosure, in each of the plurality of driving circuits, an orthographic projection of the transistor on the base substrate and an orthographic projection of the driving electrode on the base substrate at least partially overlap.

For example, the microfluidic chip provided by an embodiment of the present disclosure further comprises a plurality of first signal lines and a plurality of second signal lines; the plurality of driving circuits in the driving circuit array are arranged in an array of a plurality of rows and a plurality of columns, first terminals of driving circuits in a same row of the plurality of driving circuits are coupled to the first decoding circuit through a same first signal line in the plurality of first signal lines; second terminals of driving circuits in a same column of the plurality of driving circuits are coupled to the second decoding circuit through a same second signal line in the plurality of second signal lines.

For example, in the microfluidic chip provided by an embodiment of the present disclosure, the plurality of first signal lines are in one-to-one correspondence to the plurality of rows of the plurality of driving circuits in the driving circuit array, and the plurality of second signal lines are in one-to-one correspondence to the plurality of columns of the plurality of driving circuits in the driving circuit array.

For example, in the microfluidic chip provided by an embodiment of the present disclosure, the first decoding circuit comprises a plurality of cascaded shift register units, the plurality of cascaded shift register units are configured to output a plurality of scan driving signals, and the plurality of scan driving signals comprise the target scan driving signal.

For example, in the microfluidic chip provided by an embodiment of the present disclosure, the base substrate comprises an intermediate region and a peripheral region surrounding the intermediate region, the driving circuit array is integrated in the intermediate region, and the first decoding circuit and the second decoding circuit are integrated in the peripheral region.

For example, the microfluidic chip provided by an embodiment of the present disclosure further comprises a signal input circuit; the signal input circuit is integrated in the peripheral region and is coupled to the first decoding circuit and the second decoding circuit; and the signal input circuit comprises a plurality of power supply interfaces, a plurality of control signal interfaces, and a plurality of data signal interfaces.

For example, in the microfluidic chip provided by an embodiment of the present disclosure, the plurality of control signal interfaces comprise a scan clock signal interface, and output clock signal terminals of the plurality of cascaded shift register units are coupled to the scan clock signal interface.

For example, in the microfluidic chip provided by an embodiment of the present disclosure, the first decoding circuit further comprises an inverting sub-circuit, an output clock signal terminal of a (2L−1)-th stage shift register unit is coupled to the scan clock signal interface, and an output clock signal terminal of a (2L)-th stage shift register unit is coupled to the scan clock signal interface through the inverting sub-circuit; or, the output clock signal terminal of the (2L−1)-th stage shift register unit is coupled to the scan clock signal interface through the inverting sub-circuit, the output clock signal terminal of the (2L)-th stage shift register unit is coupled to the scan clock signal interface, and L is an integer greater than 0.

For example, in the microfluidic chip provided by an embodiment of the present disclosure, the plurality of control signal interfaces further comprise a scan enable signal interface, and the first decoding circuit further comprises a scan output control sub-circuit, the scan output control sub-circuit is coupled to the scan enable signal interface and is configured to receive the plurality of scan driving signals and output the target scan driving signal of the plurality of scan driving signals to the driving circuit array under control of the scan enable signal interface.

For example, in the microfluidic chip provided by an embodiment of the present disclosure, the plurality of data signal interfaces are configured to receive a plurality of data signals, the second decoding circuit is coupled to the plurality of data signal interfaces, and is configured to receive the plurality of data signals and generate the target driving voltage signal according to the plurality of data signals.

For example, in the microfluidic chip provided by an embodiment of the present disclosure, the second decoding circuit comprises M output channels and a multiplexing circuit, and the plurality of driving circuits are arranged in an array of M columns, the M output channels respectively correspond to the M columns driving circuits of the plurality of driving circuits for outputting the target driving voltage signal, the multiplexing circuit is coupled to the plurality of data signal interfaces to receive the plurality of data signals.

For example, in the microfluidic chip provided by an embodiment of the present disclosure, the second decoding circuit further comprises a voltage amplification sub-circuit, the voltage amplification sub-circuit is coupled to the M output channels and the multiplexing circuit, the multiplexing circuit is configured to apply the plurality of data signals to the voltage amplification sub-circuit, the voltage amplification sub-circuit is configured to receive and amplify the plurality of data signals, determine the target driving voltage signal according to the plurality of data signals which are amplified, and output the target driving voltage signal to an output channel, which corresponds to the target driving voltage signal, among the M output channels.

At least one embodiment of the present disclosure also provides a driving method of the microfluidic chip according to any one of the above embodiments, the driving method comprises: determining a first target driving circuit among the plurality of driving circuits; providing a first target scan driving signal for the first target driving circuit; providing a first target driving voltage signal for the first target driving circuit, the first target driving circuit is driven by the first target scan driving signal and the first target driving voltage signal to control the operation of the liquid droplet.

For example, in the driving method provided by an embodiment of the present disclosure, the plurality of driving circuits further comprise an initial driving circuit, the initial driving circuit is adjacent to the first target driving circuit, controlling the operation of the liquid droplet comprises: at an initial time, the liquid droplet being located over the initial driving circuit; and at a first time after the initial time, driving the first target driving circuit by the first target scan driving signal and the first target driving voltage signal to control the liquid droplet to move from the initial driving circuit to the first target driving circuit.

For example, the driving method provided by an embodiment of the present disclosure further comprises: determining a second target driving circuit among the plurality of driving circuits; providing a second target scan driving signal for the second target driving circuit; providing a second target driving voltage signal for the second target driving circuit, the first target driving circuit is adjacent to the second target driving circuit, and controlling the operation of the liquid droplet further comprises: at a second time after the first time, driving the second target driving circuit by the second target scan driving signal and the second target driving voltage signal to control the liquid droplet to move from the first target driving circuit to the second target driving circuit.

For example, in the driving method provided by an embodiment of the present disclosure, the first target driving circuit and the second target driving circuit are located in a same row, the first target scan driving signal is identical to the second target scan driving signal, and the first target driving voltage signal is different from the second target driving voltage signal.

For example, in the driving method provided by an embodiment of the present disclosure, the first target driving circuit and the second target driving circuit are located in a same column, the first target scan driving signal is different from the second target scan driving signal, and the first target driving voltage signal is identical to the second target driving voltage signal.

BRIEF DESCRIPTION OF THE DRAWINGS

In order to clearly illustrate the technical solutions of the embodiments of the present disclosure, the drawings of the embodiments will be briefly described in the following; and it is obvious that the described drawings are only related to some embodiments of the present disclosure and thus are not limitative to the present disclosure.

DETAILED DESCRIPTION

Figure 1:
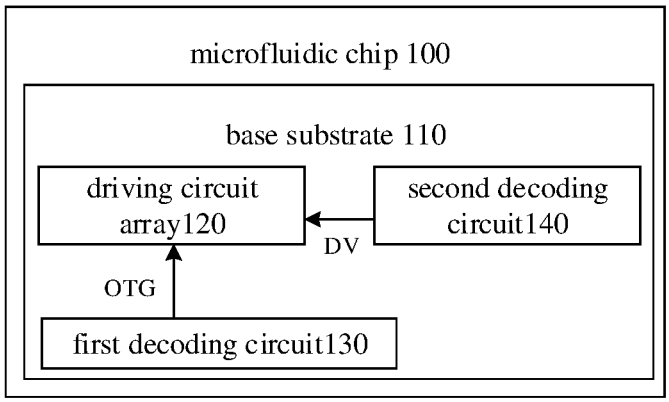
FIG. 1 is a schematic block diagram of a microfluidic chip provided by an embodiment of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "comprise," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may comprise an electrical connection, directly or indirectly. "On," "under," "right," "left" and the like are only used to indicate relative position relationship, and when the position of the object which is described is changed, the relative position relationship may be changed accordingly. In order to keep the following description of embodiments of the present disclosure clear and concise, the present disclosure omits detailed descriptions of some known functions and known components.

A microfluidic system is a micro full analysis system that integrates microfluidic channels, micropumps, microvalves, micro-reservoirs, microelectrodes, detection elements, windows, connectors, and other functional components on chip materials through microfabrication technology. In the microfluidic system, the microfluidic chip mainly operate on continuous fluids. The microfluidic chip has many advantages that: the consumption of samples and reaction reagents is reduced, thus saving costs, reducing reaction time, improving efficiency, etc.

At present, in microfluidic systems, electrode driving signals in the microfluidic chip need to be directly led out to an external driving system, thus causing problems in connection between a base substrate and the external driving system. At the same time, due to the large number of electrodes on the microfluidic chip, the number of pins of the external driving system is also large, causing that cost and complexity of the external driving system are increased.

At least one embodiment of the present disclosure provides a microfluidic chip and a driving method thereof. In the microfluidic chip, by integrating a first decoding circuit and a second decoding circuit on a base substrate to achieve accurate control of a single driving circuit, the number of connection pins between the base substrate and the external driving system can be reduced, while the complexity of the external driving system is reduced, and the cost of the microfluidic chip is reduced.

Embodiments of the present disclosure are described in detail below with reference to the accompanying drawings, but the present disclosure is not limited to these specific embodiments.

Figure 2:
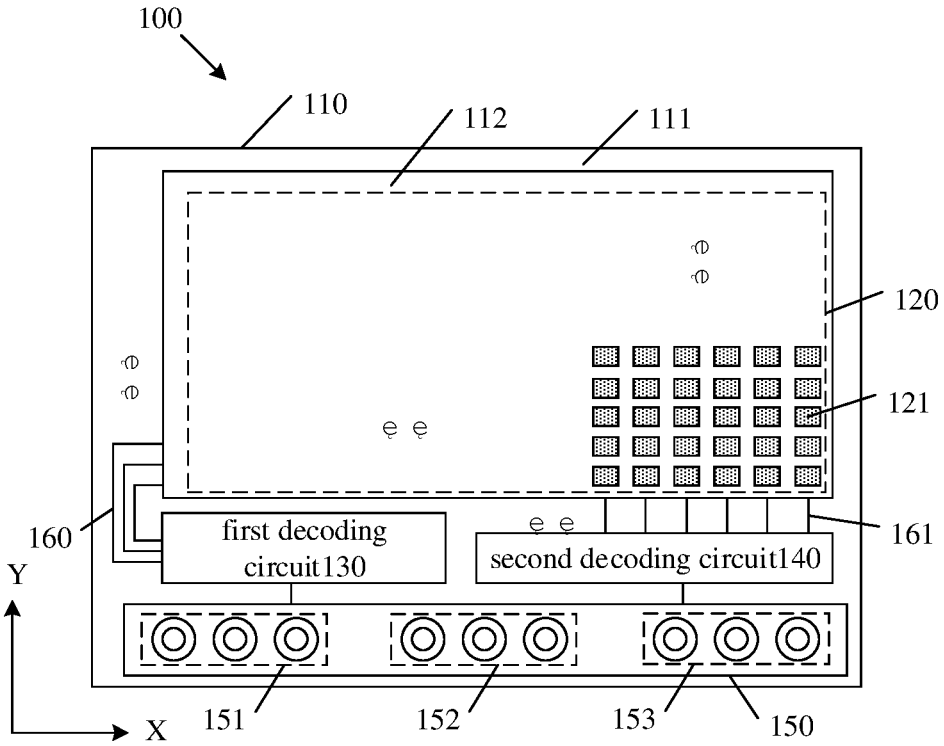
FIG. 2 is a plane structure schematic diagram of a microfluidic chip provided by an embodiment of the present disclosure.

FIG. 1 is a schematic block diagram of a microfluidic chip provided by an embodiment of the present disclosure, and FIG. 2 is a plane structure schematic diagram of a microfluidic chip provided by an embodiment of the present disclosure.

For example, as shown in FIG. 1, the microfluidic chip 100 provided by an embodiment of the present disclosure may include a base substrate 110, a driving circuit array 120, a first decoding circuit 130, and a second decoding circuit 140. The driving circuit array 120, the first decoding circuit 130, and the second decoding circuit 140 are all directly prepared on the base substrate 110, and thus are integrated on the base substrate 110. The first decoding circuit 130 is configured to generate and output a target scan driving signal OTG to the driving circuit array 120; and the second decoding circuit 140 is configured to generate and output a target driving voltage signal DV to the driving circuit array 120.

For example, as shown in FIG. 2, the driving circuit array 120 may include a plurality of driving circuits 121 arranged in an array, and the driving circuit array 120 is configured to control an operation of a liquid droplet over the driving circuit array 120 based on the target scan driving signal OTG and the target driving voltage signal DV. It should be noted that FIG. 2 only shows part of the driving circuits 121 in the driving circuit array 120.

For example, operations performed on the liquid droplet include basic operations, such as movement, splitting, mixing of the liquid droplet, and the like.

For example, the base substrate 110 may be a glass substrate, a ceramic substrate, a plastic substrate, etc. For example, the base substrate may be a printed circuit board including a circuit, etc.

For example, as shown in FIG. 2, the base substrate 110 may include an intermediate region 112 and a peripheral region 111 surrounding the intermediate region 112. The driving circuit array 120 is integrated in the intermediate region 112, and the first decoding circuit 130 and the second decoding circuit 140 are integrated in the peripheral region 111. In an example, the first decoding circuit 130 and the second decoding circuit 140 may be located on the same side of the intermediate region 112 (a lower side as shown in FIG. 2). For example, as shown in FIG. 2, the first decoding circuit 130 and the second decoding circuit 140 may be located on the same side of the intermediate region 112, and on the base substrate 110, the first decoding circuit 130 and the second decoding circuit 140 are arranged along a first direction X. However, the present disclosure is not limited thereto, the first decoding circuit 130 and the second decoding circuit 140 may be arranged along a second direction Y on the base substrate 110. In addition, in other examples, the first decoding circuit 130 and the second decoding circuit 140 may be located on both sides of the intermediate region 112, respectively. For example, the first decoding circuit 130 is located on a left side of the intermediate region 112 and the second decoding circuit 140 is located on a lower side of the intermediate region 112.

For example, the first direction X and the second direction Y are perpendicular to each other.

For example, a first terminal of each of the plurality of driving circuits 121 is coupled to the first decoding circuit 130 to receive a signal (e.g., the above-mentioned target scan driving signal OTG), and a second terminal of each of the plurality of driving circuits 121 is coupled to the second decoding circuit 140 to receive a signal (e.g., the above-mentioned target driving voltage signal DV).

For example, as shown in FIG. 2, the microfluidic chip 100 further includes a plurality of first signal lines 160 and a plurality of second signal lines 161. The plurality of driving circuits 121 are arranged in an array of a plurality of rows and a plurality of columns along the first direction X and the second direction Y in the intermediate region 120, for example, a row direction of the plurality of driving circuits 121 is parallel to the first direction X, and a column direction of the plurality of driving circuits 121 is parallel to the second direction Y. The first terminals of the driving circuits located in the same row of the plurality of driving circuits 121 are coupled to the first decoding circuit 130 through the same first signal line in the plurality of first signal lines 160; and the second terminals of the driving circuits located in the same column of the plurality of driving circuits 121 are coupled to the second decoding circuit 140 through the same second signal line 161 in the plurality of second signal lines 161. That is, each driving circuit is coupled to the first decoding circuit 130 through a first signal line 160, and is also coupled to the second decoding circuit 140 through a second signal line 161. The driving circuits located in the same row share the same first signal line 160, and the driving circuits located in the same column share the same second signal line 161.

It should be noted that the plurality of first signal lines 160 are in one-to-one correspondence to the plurality of rows (i.e., the plurality of rows of the plurality of driving circuits in the driving circuit array 120) of the plurality of driving circuits 121, and the plurality of second signal lines 161 are in one-to-one correspondence to the plurality of columns (i.e., the plurality of columns of the plurality of driving circuits in the driving circuit array 120) of the plurality of driving circuits 121, thereby achieving accurate control of each driving circuit. For example, if the plurality of driving circuits 121 are arranged in an array of N rows and M columns, the microfluidic chip 100 may include N first signal lines 160 and M second signal lines 161, the N first signal lines 160 are in one-to-one correspondence to the N rows of the plurality of driving circuits 121, and the M second signal lines 161 are in one-to-one correspondence to the M columns of the plurality of driving circuits 121.

For example, the first signal line 160 and the second signal line 161 may be prepared with conductive materials, and the conductive materials may include indium tin oxide (ITO), indium zinc oxide (IZO), copper-based metal (e.g., copper or copper alloy), aluminum-based metal (e.g., aluminum or aluminum alloy), nickel-based metal (e.g., nickel or nickel alloy), and the like.

It should be noted that the rows and columns in the driving circuit array 120 are not limited to straight lines, but may be curved lines, such as wavy lines, sawtooth lines, and the like.

Figure 3A:
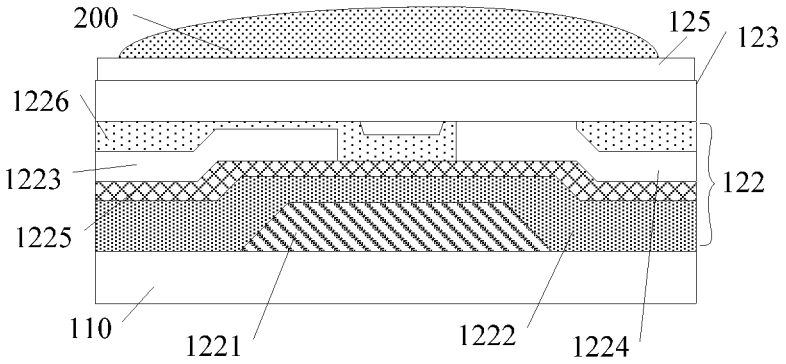
FIG. 3A is a structural schematic diagram of a driving circuit provided by an embodiment of the present disclosure.

FIG. 3A is a structural schematic diagram of a driving circuit provided by an embodiment of the present disclosure.

For example, as shown in FIG. 3A, in the driving circuit array 120, each driving circuit 121 may include a transistor 122 and a driving electrode 123, a dielectric layer 125 is provided on the driving electrode 123, and the driving electrode 123 acts on the liquid droplet 200 in operation via the dielectric layer 125. The transistor 122 may include a gate electrode 1221, a first insulating layer 1222 (i.e., a gate insulating layer), a first electrode 1223, a second electrode 1224, an active layer 1225, and a second insulating layer 1226. The first terminal of each of the plurality of driving circuits 121 includes the gate electrode 1221 of the transistor 122, and the second terminal of each of the plurality of driving circuits 121 includes the first electrode 1223 of the transistor 122. That is, in each driving circuit 121, the gate electrode 1221 of the transistor 122 is coupled to the first decoding circuit 130, and the first electrode 1223 of the transistor 122 is coupled to the second decoding circuit 140. In each of the plurality of driving circuits 121, the second electrode 1224 of the transistor 122 is connected to the driving electrode 123.

For example, the transistor 122 may be a thin film transistor, a field effect transistor, or other switching devices having the same characteristics. The thin film transistor may include an oxide thin film transistor, an amorphous silicon thin film transistor, a polysilicon thin film transistor, or the like. The first electrode 1223 of the transistor 122 may be a source electrode and the second electrode 1224 of the transistor 122 may be a drain electrode. Alternatively, the first electrode 1223 of the transistor 122 may be a drain electrode and the second electrode 1224 of the transistor 122 may be a source electrode. The transistor 122 may be a P-type transistor or an N-type transistor.

For example, the driving electrode 123 may be made of a conductive material, such as a metal material.

For example, as shown in FIG. 3A, in each driving circuit 121, an orthographic projection of the transistor 122 on the base substrate 110 and an orthographic projection of the driving electrode 123 on the base substrate 110 at least partially overlap, for example, completely overlap. For example, the orthographic projection of the driving electrode 123 on the base substrate 110 completely overlaps with the orthographic projection of the second electrode 1224 of the transistor 122 on the base substrate 110. In addition, the orthographic projection of the driving electrode 123 on the base substrate 110 also completely overlaps with the orthographic projections of the gate electrode 1221, the first electrode 1223, etc. of the transistor 122 on the base substrate 110.

For example, the plurality of driving electrodes 123 in the plurality of driving circuits 121 may have the same shape and be spaced apart from each other by a predetermined distance, so as to ensure that electrical characteristics of the plurality of driving electrodes 123 are basically consistent, and further ensure the accuracy of controlling the liquid droplet. As shown in FIG. 2, a shape of the driving electrode 123 may be rectangular, for example, may be a square. However, the present disclosure is not limited to this case. According to actual design requirements, the shape of the driving electrode 123 may also be circular, trapezoidal, etc. The embodiment of the present disclosure does not specifically limit the shape of the driving electrode 123. For example, in some examples, the plurality of driving electrodes 123 in the plurality of driving circuits 121 may also have different shapes. The plurality of driving electrodes 123 are spaced apart from each other by the predetermined distance so as to be insulated from each other.

It should be noted that, in at least one embodiment, in a direction perpendicular to the base substrate 110, a hydrophobic layer (not shown in the figure) may also be disposed above the driving electrode 123 to ensure the smoothness and stability of the movement process of the liquid droplet, and at the same time, the dielectric layer 125 may also protect the driving electrode 123. For example, the dielectric layer 125 may entirely cover the plurality of driving electrodes 123 in the plurality of driving circuits 121, thereby protecting the driving electrodes 123.

For example, a size of each driving electrode 123 may be on an order of nanometers or micrometers. A size of the liquid droplet and the size of the driving electrode 123 may be substantially the same, and a shape of the liquid droplet and a shape of the driving electrode 123 may be substantially the same. However, the present disclosure is not limited to this case, and the size and shape of the liquid droplet may be different from the size and shape of the driving electrode 123, respectively, for example, the shape of the driving electrode 123 is rectangular while the shape of the liquid droplet is circular.

Figure 3B:
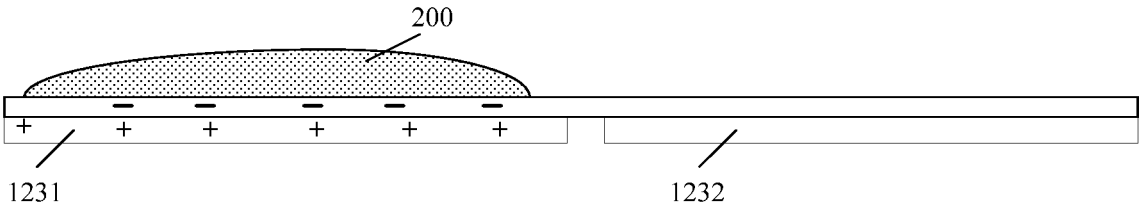
FIGS. 3B-3D are schematic diagrams of the driving circuit as shown in FIG. 3A moving a liquid droplet.
Figure 3C:
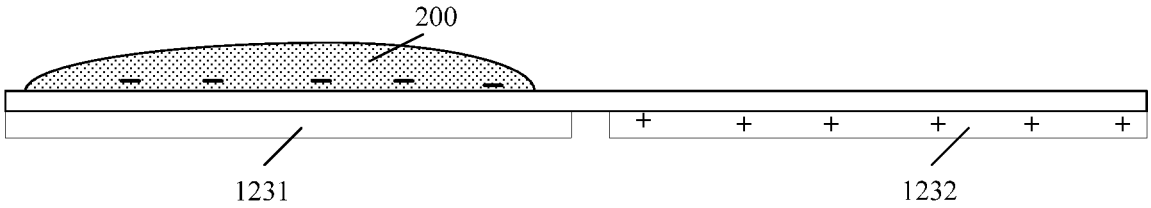
Figure 3D:
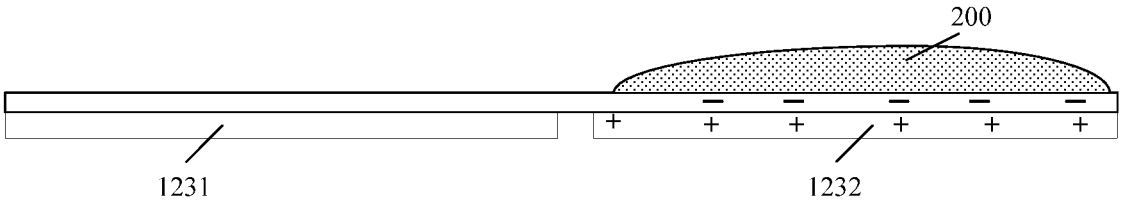

FIGS. 3B-3D are schematic diagrams of the driving circuit as shown in FIG. 3A moving the liquid droplet, FIGS. 3B-3D show the driving electrodes 1231 and 1232 of two adjacent driving circuits, the dielectric layer on the driving electrodes, and the liquid droplet 200 on the dielectric layer. As shown in FIG. 3B, after a positive driving voltage signal is applied to the driving electrode 1231 on a left side in the figure, the liquid droplet 200 moves to a position directly above the driving electrode 1231. At this moment, a portion of the dielectric layer below the liquid droplet 200 will be coupled out of corresponding negative charges, and the corresponding negative charges are uniformly distributed at a position directly above the driving electrode 1231. In order to make the liquid droplet move toward a right direction, as shown in FIG. 3C, a positive driving voltage signal is applied to the driving electrode 1232 on a right side of the figure, while no driving voltage signal is applied to the driving electrode 1231 on the left side of the figure. At this time, a portion of negative charges will remain on a surface of the liquid droplet 200, and the driving electrode 1232 will generate positive charges due to the application of positive voltage. Thus, a substantially transverse electric field is formed between the liquid droplet 200 and the driving electrode 1232, and the liquid droplet 200 moves to be above the driving electrode 1232 on the right side of the figure under the action of the electric field, as shown in FIG. 3D.

For example, as shown in FIG. 2, the microfluidic chip 100 further includes a signal input circuit 150. The signal input circuit 150 is integrated in the peripheral region 111 and is electrically coupled to the first decoding circuit 130 and the second decoding circuit 140. The signal input circuit 150 is used to transmit externally transmitted control signals, power supply signals, data signals, etc. to the first decoding circuit 130 and the second decoding circuit 140. For example, the signal input circuit 150 includes a plurality of power supply interfaces 151, a plurality of control signal interfaces 152, and a plurality of data signal interfaces 153.

It should be noted that although only three power supply interfaces 151, three control signal interfaces 152, and three data signal interfaces 153 are shown in FIG. 2, the present disclosure is not limited thereto. The number of power supply interfaces 151, the number of control signal interfaces 152, and the number of data signal interfaces 153 are designed according to actual application requirements.

For example, in some examples, the number of the plurality of power supply interfaces 151 is four and the number of the plurality of control signal interfaces 152 is six; and if the plurality of driving circuits 121 are arranged in an array of N rows and M columns, and the number of the plurality of data signal interfaces 153 is P, then M=Q×P, where N, M, P, and Q are positive integers.

Figure 4:
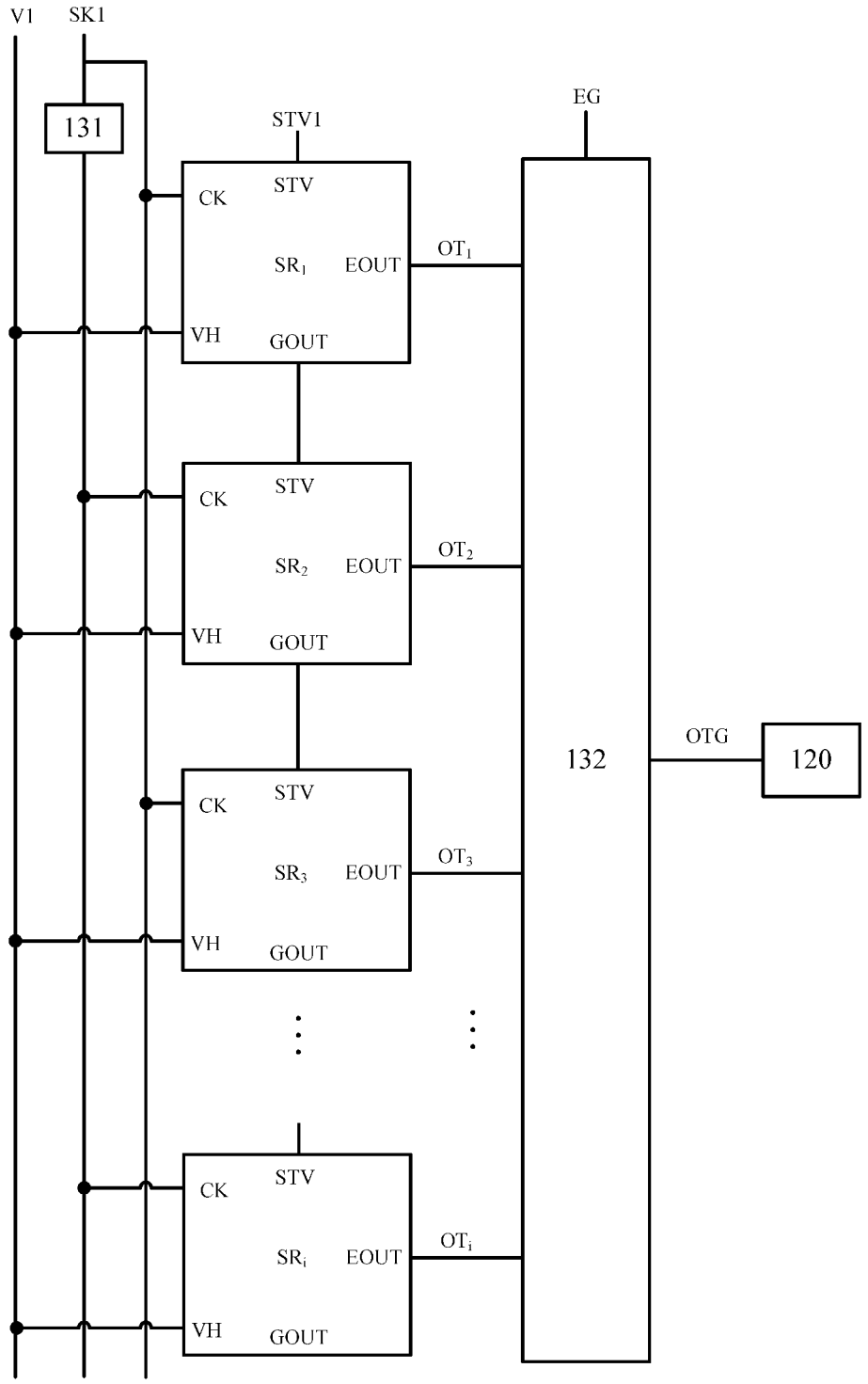
FIG. 4 is a structural schematic diagram of a first decoding circuit provided by an embodiment of the present disclosure.

FIG. 4 is a structural schematic diagram of a first decoding circuit provided by an embodiment of the present disclosure.

For example, as shown in FIG. 4, the first decoding circuit 130 may include a plurality of cascaded shift register units $SR_1$, $SR_2$, $SR_3$, . . . , $SR_i$. The plurality of cascaded shift register units $SR_1$, $SR_2$, $SR_3$, . . . , $SR_i$ are configured to output a plurality of scan driving signals (for example, the plurality of scan driving signals may be $OT_1$, $OT_2$, $OT_3$, . . . , $OT_i$ as shown in FIG. 4), and the plurality of scan driving signals include a target scan driving signal OTG. For example, output terminals EOUT of the plurality of cascaded shift register units are configured to respectively output the plurality of scan driving signals. For example, the plurality of scan driving signals respectively correspond to the plurality of cascaded shift register units one by one, i.e., each shift register unit outputs one scan driving signal. For example, the shift register unit $SR_1$ outputs the scan driving signal $OT_1$, the shift register unit $SR_2$ outputs the scan driving signal $OT_2$, the shift register unit $SR_3$ outputs the scan driving signal $OT_3$, and the shift register unit $SR_i$ outputs the scan driving signal $OT_i$.

For example, the driving circuit array 120 may include a target driving circuit and the target driving circuit is configured to control the liquid droplet to perform corresponding operations. The target scan driving signal may be a scan driving signal, which corresponds to the target driving circuit, among the plurality of scan driving signals. For example, in an example, if the target driving circuit is located in a fifth row, the scan driving signal, which corresponds to the fifth row of driving circuits, among the plurality of scan driving signals is the target scan driving signal.

It should be noted that the target driving circuit indicates the driving circuit selected at the current time, and all driving circuits located in the same row as the target driving circuit can receive the target scan driving signal.

For example, as shown in FIG. 4, in some embodiments, the plurality of control signal interfaces 152 include a scan clock signal interface SK1, and the scan clock signal interface SK1 is used for outputting a scan clock signal. Output clock signal terminals CK of the plurality of cascaded shift register units $SR_1$, $SR_2$, $SR_3$, . . . , $SR_i$ are all connected to the scan clock signal interface SK1, and the scan driving signals are sequentially output under the control of the scan clock signal. The embodiment of the present disclosure is not limited to the specific implementation form of each shift register unit, and the other shift register units include transistors, capacitors, and the like, so that the shift register units can be conveniently integrated on the base substrate through a semiconductor manufacturing process.

For example, as shown in FIG. 4, the first decoding circuit 130 further includes an inverting sub-circuit 131. In some examples, an output clock signal terminal CK of a (2L−1)-th stage shift register unit (e.g., a first stage shift register unit $SR_1$, a third stage shift register unit $SR_3$, etc.) is connected to the scan clock signal interface SK1, and an output clock signal terminal CK of a (2L)-th stage shift register unit (e.g., a second stage shift register unit $SR_2$, etc.) is connected to the scan clock signal interface SK1 through the inverting sub-circuit 131, where L is an integer greater than 0. For example, an input terminal of the inverting sub-circuit 131 is connected to the scan clock signal interface SK1, and the output terminal of the inverting sub-circuit 131 is connected to the output clock signal terminal CK of the (2L)-th stage shift register unit. The inverting sub-circuit 131 is used for inverting the scan clock signal and transmitting the inverted scan clock signal to the output clock signal terminal CK of the (2L)-th stage shift register unit. Thus, in some embodiments of the present disclosure, the function of controlling the plurality of cascaded shift register units $SR_1$, $SR_2$, $SR_3$, . . . , $SR_i$ can be achieved through only one scan clock signal interface SK, thereby reducing the number of control signal interfaces.

For example, in other examples, the output clock signal terminal CK of the (2L−1)-th stage shift register unit (e.g., the first stage shift register unit SR1, the third stage shift register unit SR3, etc.) is connected to the scan clock signal interface SK1 through the inverting sub-circuit 131, and the output clock signal terminal CK of the (2L)-th stage shift register unit (e.g., the second stage shift register unit SR2, etc.) is connected to the scan clock signal interface SK1.

For example, the inverting sub-circuit 131 may include an inverter, and the inverter may be various appropriate types, for example, the inverter may include a CMOS inverter, a TTL NOT gate, or the like.

For another example, in other embodiments, the plurality of control signal interfaces 152 may include a first scan clock signal interface and a second scan clock signal interface, and a phase of the scan clock signal output by the first scan clock signal interface is opposite to a phase of the scan clock signal output by the second scan clock signal interface. The output clock signal terminal CK of the (2L−1)-th stage shift register unit is connected to the first scan clock signal interface, and the output clock signal terminal CK of the (2L)-th stage shift register unit is connected to the second scan clock signal interface. In this case, the first decoding circuit 130 may not be provided with the inverting sub-circuit 131.

For example, as shown in FIG. 4, except for the first stage shift register unit SR1, an input voltage terminal STV of a current stage shift register unit is electrically connected to a shift signal output terminal GOUT of a previous stage shift register unit, so that an operation state of a next stage shift register unit is controlled by the shift signal output signal GOUT of the previous stage shift register unit, to achieve sequentially outputting the plurality of scan driving signals.

For example, as shown in FIG. 4, the plurality of control signal interfaces 152 may further include a first trigger signal terminal STV1. The input voltage terminal STV of the first stage shift register unit $SR_1$ is connected to the first trigger signal terminal STV1, and the first trigger signal terminal STV1 is configured to provide a first trigger signal to control the first decoding circuit 130 to start outputting the scan driving signals.

For example, as shown in FIG. 4, the plurality of power supply interfaces 151 include a first power supply interface V1, and the first power supply interface V1 is configured to receive a first power supply voltage. Power supply terminals VGH of the plurality of cascaded shift register units $SR_1$, $SR_2$, $SR_3$, . . . , $SR_i$ are all connected to the first power supply interface V1. For example, in at least one embodiment, each shift register unit may further include a buffer amplification sub-circuit, and the buffer amplification sub-circuit is configured to amplify signals generated by respective shift register units based on the first power supply voltage to obtain a plurality of scan driving signals. Because the load capacitance formed by transistors, driving electrodes, etc. is large, the drive capability of the scan signals generated by respective shift register units may not be sufficient. Therefore, it is necessary to amplify the signals generated by respective shift register units through the buffer amplification sub-circuit to increase the drive capability of the plurality of scan driving signals.

For example, as shown in FIG. 4, the plurality of control signal interfaces 152 further include a scan enable signal interface EG, the first decoding circuit 130 further includes a scan output control sub-circuit 132, the scan output control sub-circuit 132 is connected to the scan enable signal interface EG, the scan output control sub-circuit 132 is connected to the output terminals EOUT of the plurality of cascaded shift register units to receive the plurality of scan driving signals, and the scan output control sub-circuit 132 is also connected to the driving circuit array 120. The scan output control sub-circuit 132 is configured to select a target scan driving signal OTG from the plurality of scan driving signals under control of the scan enable signal output from the scan enable signal interface EG, and output the target scan driving signal OTG to the driving circuit array 120. Thus, in the present disclosure, in one scan period (i.e., a time period from the output of the scan driving signal from the first stage shift register unit $SR_1$ to the output of the scan driving signal from a last stage shift register unit $SR_i$), it is not necessary to perform scan operations on all rows in the driving circuit array, but the scan operations are performed only on one or several rows (when the driving circuit array 120 includes a plurality of target driving circuits and the plurality of target driving circuits are located in different rows) where the target driving circuits are located. However, the present disclosure is not limited to this case, and in some embodiments, the plurality of scan driving signals may be sequentially output to the driving circuit array 120 to perform a progressive scan operation on the driving circuit array 120.

It should be noted that the scan output control sub-circuit 132 may also be connected to an external control circuit to obtain relevant information of the target driving circuit, for example, the relevant information may include the row where the target driving circuit is located, etc.

Figure 5:
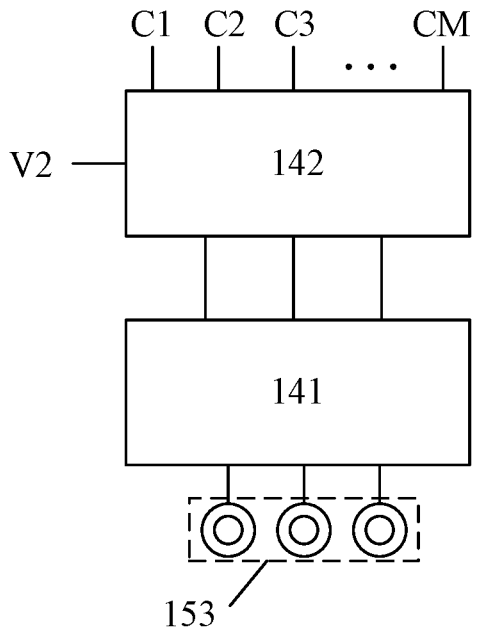
FIG. 5 is a structural schematic diagram of a second decoding circuit provided by an embodiment of the present disclosure.

FIG. 5 is a structural schematic diagram of a second decoding circuit provided by an embodiment of the present disclosure.

For example, as shown in FIG. 5, the second decoding circuit 140 may include M output channels (e.g., C1, C2, C3, . . . , CM as shown in FIG. 5) and a multiplexing circuit 141. The plurality of data signal interfaces 153 are configured to receive a plurality of data signals, and the second decoding circuit 140 is coupled to the plurality of data signal interfaces 153, so that the plurality of data signals are transmitted to the second decoding circuit 140, the second decoding circuit 140 is configured to receive the plurality of data signals and generate the target driving voltage signal according to the plurality of data signals. For example, the multiplexing circuit 141 is coupled to the plurality of data signal interfaces 153 to receive the plurality of data signals, and is configured to apply the plurality of data signals to the M output channels respectively, for example, via a voltage amplification sub-circuit 142 to be described below. The M output channels respectively correspond to the M columns of the plurality of driving circuits and is used for outputting the target driving voltage signals; and for example, each output channel may include a register, so the data signal input by the multiplexing circuit 141 may be buffered.

For example, the plurality of power supply interfaces 151 include a second power supply interface V2, and the second power supply interface V2 is configured to receive a second power supply voltage. The second decoding circuit 140 includes a voltage amplification sub-circuit 142, the multiplexing circuit 141 is configured to apply the plurality of data signals to the voltage amplification sub-circuit 142, the voltage amplification sub-circuit 142 is configured to receive the plurality of data signals transmitted via the multiplexing circuit 141, amplify the plurality of data signals based on the second power supply voltage to generate the target driving voltage signal (e.g., the voltage amplification sub-circuit 142 is configured to amplify the plurality of data signals based on the second power supply voltage to obtain a plurality of amplified data signals, then determine the target driving voltage according to the plurality of amplified data signals, i.e., select a required data signal as the target driving voltage signal from the plurality of amplified data signals), and transmit the target driving voltage signal to an output channel, which corresponds to the target driving voltage signal, among the M output channels, so that the corresponding output channel outputs the target driving voltage signal to the driving circuit array 120.

For example, if the number of the plurality of data signal interfaces 153 is P and M=Q×P, the M output channels may be correspondingly divided into Q output channel groups, each output channel group includes P output channels. One driving period (i.e., the valid time of the target scan driving signal) may include Q first sub-cycles. In each first sub-cycle, P data signal interfaces transmit P data signals in parallel to the multiplexing circuit 141. The multiplexing circuit 141 transmits the received P data signals to the voltage amplification sub-circuit 142, and the P data signals are respectively output to P output channels of a certain group after being amplified by the voltage amplification sub-circuit 142, and are stored in the P output channels of the certain group, i.e., in each first sub-cycle, P data signals are simultaneously transmitted to the multiplexing circuit 141. Thus, the P data signal interfaces can transmit M data signals to the multiplexing circuit 141 in one driving period.

For example, in some examples, the driving circuit array 120 includes one target driving circuit, then the M data signals include only one valid data signal, and the remaining (M−1) data signals are all invalid data signals. For example, the invalid data signal may also indicate no signal transmission, that is, in one driving period, only one data signal is actually transmitted to the multiplexing circuit 141 and then transmitted to the voltage amplification sub-circuit 142. The voltage amplification sub-circuit 142 may amplify the valid data signal to generate the target driving voltage signal, and transmit the target driving voltage signal to a corresponding output channel (for example, hereinafter referred to as a target output channel), and the target output channel transmits the target driving voltage signal to the target driving circuit. For another example, the invalid data signal may be 0V, and the M data signals may be transmitted to the multiplexing circuit 141 in a time-sharing manner and then transmitted to the voltage amplification sub-circuit 142. The voltage amplification sub-circuit 142 may amplify the M data signals to generate M driving voltage signals, the M driving voltage signals include a target driving voltage signal and (M−1) invalid driving voltage signals, and the target driving voltage signal is a driving voltage signal, which corresponds to the target driving circuit, among the M driving voltage signals. The M driving voltage signals can be respectively transmitted to the M output channels, the target driving voltage signal is transmitted to the target output channel, and the target output channel transmits the target driving voltage signal to the target driving circuit. For example, in an example, if the target driving circuit is located in a fifth column, the output channel, which corresponds to the fifth column of the driving circuits, among the M output channels is the target output channel.

It should be noted that all the driving circuits located in the same column as the target driving circuit can receive the target driving voltage signal. Because the transistor in the target driving circuit is in a turn-on state and the transistors of all non-target driving circuits except the target driving circuit are in a turn-off state, the target driving voltage signal can only be transmitted to the driving electrode of the target driving circuit.

For example, the plurality of power supply interfaces 151 may further include a third power supply interface and a fourth power supply interface (not shown). The third power supply interface is configured to receive a third power supply voltage, and the third power supply voltage is used for supplying power to the first decoding circuit 130 and the second decoding circuit 140. The fourth power interface may be grounded.

Figure 6:
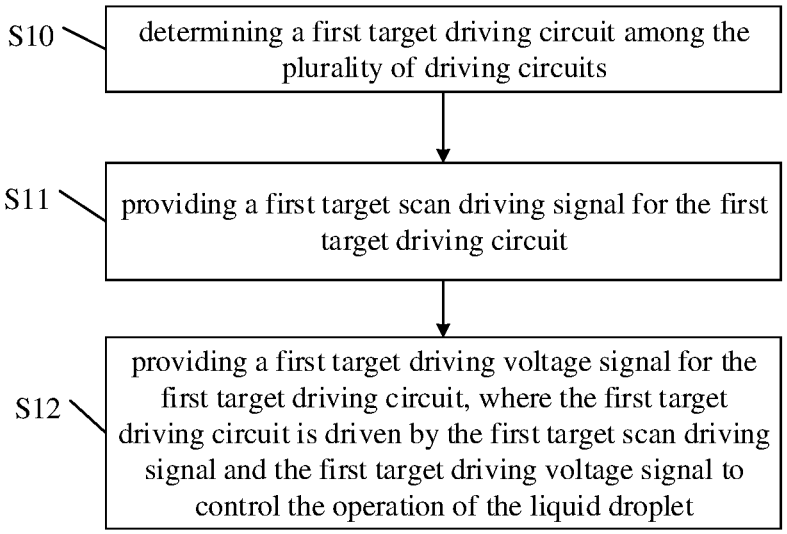
FIG. 6 is a schematic flow chart of a driving method of a microfluidic chip provided by an embodiment of the present disclosure.

FIG. 6 is a schematic flow chart of a driving method of a microfluidic chip provided by an embodiment of the present disclosure.

For example, the microfluidic chip may be the microfluidic chip 100 described in any one of the above embodiments. As shown in FIG. 6, the driving method may include the following steps.

S10: determining a first target driving circuit among the plurality of driving circuits.

S11: providing a first target scan driving signal for the first target driving circuit.

S13: providing a first target driving voltage signal for the first target driving circuit, where the first target driving circuit is driven by the first target scan driving signal and the first target driving voltage signal to control the operation of the liquid droplet.

For example, in step S10, at least one target driving circuit in the driving circuit array may be determined according to actual operation requirements, and the at least one target driving circuit may include the first target driving circuit. The number of the target driving circuits can be set according to actual application, and the present disclosure is not limited to this case.

Figure 7A:
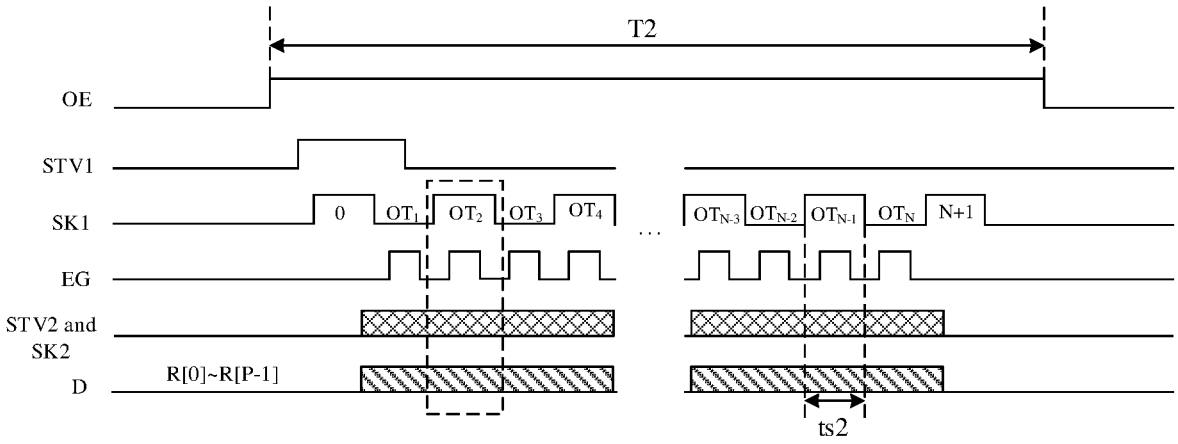
FIG. 7A is a timing chart of a driving method of a microfluidic chip provided by an embodiment of the present disclosure.
Figure 7B:
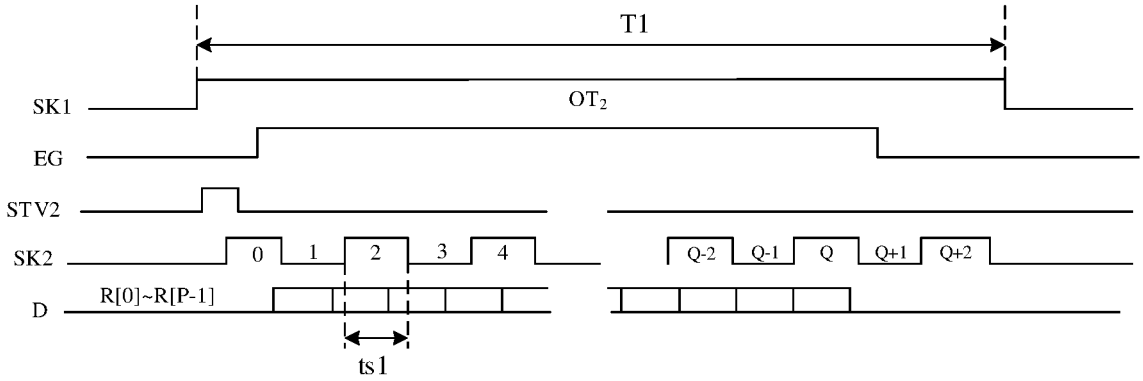
FIG. 7B is an enlarged schematic diagram of a dashed box portion as shown in FIG. 7A.

FIG. 7A is a timing chart of a driving method of a microfluidic chip provided by an embodiment of the present disclosure, and FIG. 7B is an enlarged schematic diagram of a dashed box portion as shown in FIG. 7A. FIGS. 7A and 7B are timing charts for sequentially driving all driving circuits on the microfluidic chip.

For example, as shown in FIGS. 7A and 7B, a driving period is T1, and the driving period T1 includes (Q+3) first sub-periods, each first sub-period is denoted as ts1. The (Q+3) first sub-periods may all be the same, but the present disclosure is not limited thereto, and the (Q+3) first sub-periods may also be at least partially different according to actual application requirements. A scan period is T2, and the scan period T2 includes (N+2) second sub-periods (which include two dummy second sub-periods), each second sub-period is denoted as ts2, and the scan driving signal can be output in each second sub-period ts2 to scan a row of driving circuits. The (N+2) second sub-periods may all be the same, but the present disclosure is not limited thereto, and the (N+2) second sub-periods may also be at least partially different according to actual application requirements. For example, the driving period T1 may be the same as the second sub-period ts2, but the present disclosure is not limited thereto, and the driving period T1 may also be smaller than the second sub-period ts2.

It should be noted that, as shown in FIG. 7A, the (N+2) second sub-periods in the scan period T2 may include two dummy second sub-periods, and the two dummy second sub-periods are denoted by reference numerals 0 and (N+1), respectively. In the two dummy second sub-periods, the first decoding circuit does not generate the scan driving signal. As shown in FIG. 7B, the (Q+3) first sub-periods in the driving period T1 include three dummy first sub-periods, and the three dummy first sub-periods are denoted by reference numerals 0, (Q+1), and (Q+2), respectively. During the three dummy first sub-periods, the plurality of data signal interfaces do not transmit the data signals to the second decoding circuit. The driving period T1 also includes two dummy first sub-periods, four dummy first sub-periods, etc., and the scan period T2 also includes three dummy second sub-periods, four dummy second sub-periods, etc.

The present disclosure does not specifically limit the number of the dummy first sub-periods and the number of the dummy second sub-periods.

For example, the microfluidic chip includes the plurality of control signal interfaces and the plurality of data signal interfaces. As shown in FIGS. 7A and 7B, the plurality of control signal interfaces may include a circuit enable signal interface OE, a first trigger signal terminal STV1, a scan clock signal interface SK1, a scan enable signal interface EG, a second trigger signal terminal STV2, and a voltage clock signal interface SK2. The circuit enable signal interface OE is used to receive a circuit enable signal, the first trigger signal terminal STV1 is used to receive the first trigger signal, the scan clock signal interface SK1 is used to receive the scan clock signal, the scan enable signal interface EG is used to receive the scan enable signal, the second trigger signal terminal STV2 is used to receive the second trigger signal, and the voltage clock signal interface SK2 is used to receive the voltage clock signal. The circuit enable signal is used to control the working states of the first trigger circuit and the second trigger circuit. In the case where the circuit enable signal is valid, the first trigger circuit and the second trigger circuit work normally. In the case where the circuit enable signal is invalid, the first trigger circuit and the second trigger circuit do not work. The second trigger signal is used to trigger the second decoding circuit to start outputting the driving voltage signals. The voltage clock signal is used for controlling the second decoding circuit to sequentially output the plurality of driving voltage signals.

For example, the plurality of data signal interfaces include a first data signal interface R[0] to a (P)-th data signal interface R[P−1]. The first data signal interface R[0] to the (P)-th data signal interface R[P−1] are used for outputting P data signals in parallel in each first sub-period ts1.

It should be noted that in the present disclosure, the circuit enable signal, the scan enable signal, the first trigger signal, and the second trigger signal are valid in the case where the circuit enable signal, the scan enable signal, the first trigger signal, and the second trigger signal are at high levels, but are invalid in the case where the circuit enable signal, the scan enable signal, the first trigger signal, and the second trigger signal are at low levels. The description of the first trigger signal, the scan clock signal, and the scan enable signal can refer to the relevant description in the embodiment of the microfluidic chip described above, and the repetition will not be repeated here again.

For example, as shown in FIG. 7A, firstly, the first trigger signal terminal STV1 outputs a valid first trigger signal to drive the first decoding circuit to start operating. The plurality of cascaded shift register units of the first decoding circuit sequentially generate and output the plurality of scan driving signals (the scan driving signals $OT_1$ to $OT_N$ as shown in FIG. 7A). In each second sub-period ts2, the scan enable signals output by the scan enable signal interface EG are all valid, so that the plurality of scan driving signals are sequentially output to the driving circuit array to sequentially scan the driving circuit array row by row.

For example, as shown in FIG. 7B, by taking a case that the scan driving signal OT2 is output to the driving circuit array as an example, in the driving period T1, the second trigger signal terminal STV2 outputs a valid second trigger signal to drive the second decoding circuit to start operating, in each first sub-period ts1, the first data signal interface R[0] to the (P)-th data signal interface R[P−1] output P data signals to the second decoding circuit in parallel. The second decoding circuit processes the P data signals to generate P driving voltage signals, and then the P driving voltage signals are simultaneously and respectively transmitted to the driving electrodes of the P column of the driving circuits, thereby controlling the driving circuit array. In Q first sub-periods ts1 (denoted by reference numerals 1 to Q respectively as shown in FIG. 7B), the second decoding circuit may output M driving voltage signals to the driving circuit array. For example, in each first sub-period ts1, the first data signal interface R[0] to the (P)-th data signal interface R[P−1] transmit P data signals in parallel to the multiplexing circuit 141 of the second decoding circuit, Then, the P data signals are amplified by the voltage amplification sub-circuit of the second decoding circuit, and then the amplified P data signals are respectively output to P output channels of a certain group of the Q output channel groups (M output channels can be divided into the Q output channel groups, each output channel group includes the P output channels) and are stored in the P output channels of the certain group.

Figure 8A:
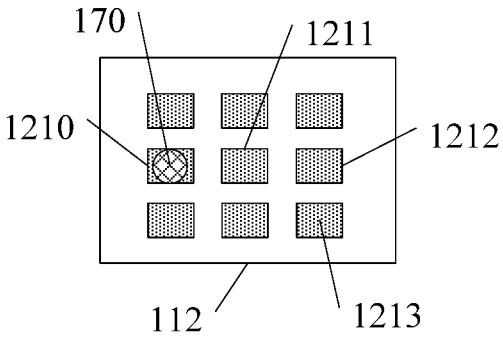
FIG. 8A is a partial plane schematic diagram of a microfluidic chip at an initial time provided by an embodiment of the present disclosure.
Figure 8B:
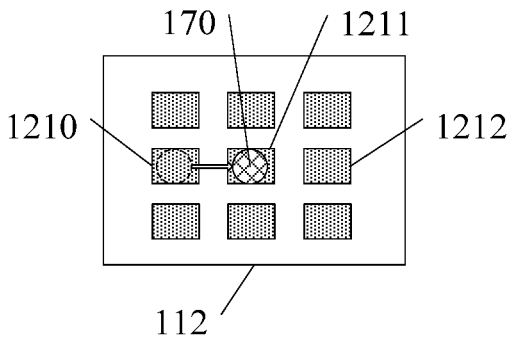
FIG. 8B is a partial plane schematic diagram of a microfluidic chip at a first time provided by an embodiment of the present disclosure.
Figure 8C:
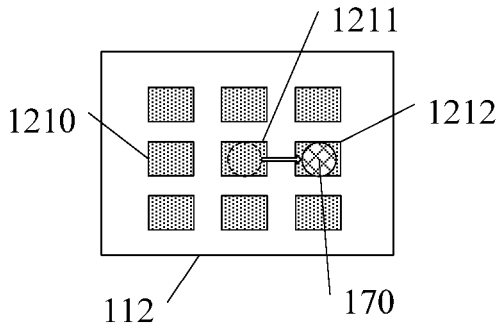
FIG. 8C is a partial plane schematic diagram of a microfluidic chip at a second time provided by an embodiment of the present disclosure.
Figure 9A:
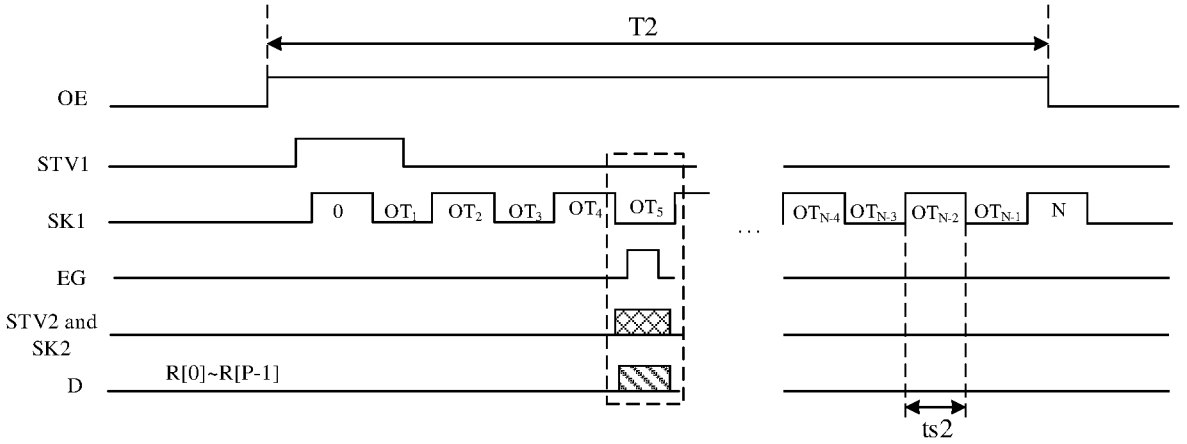
FIG. 9A is a timing chart of a driving method of a microfluidic chip at a first time provided by an embodiment of the present disclosure.
Figure 9B:
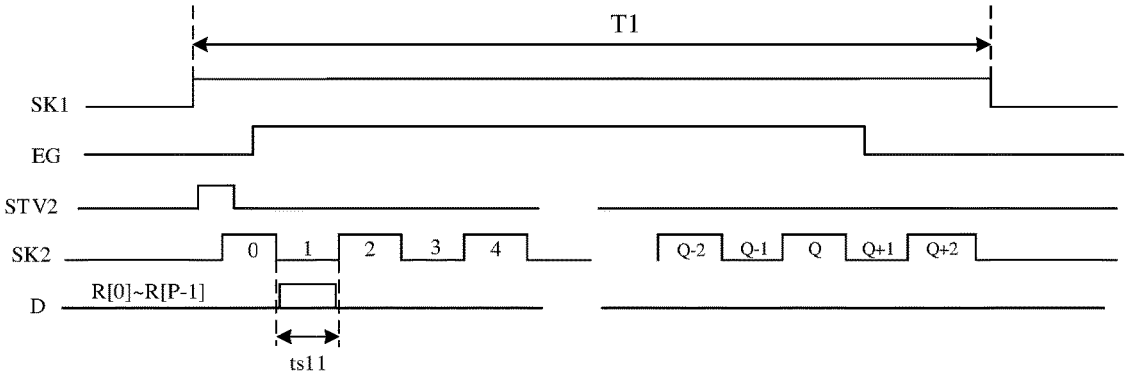
FIG. 9B is an enlarged schematic view of a dashed box portion in FIG. 9A.

FIG. 8A is a partial plane schematic diagram of a microfluidic chip at an initial time provided by an embodiment of the present disclosure, FIG. 8B is a partial plane schematic diagram of a microfluidic chip at a first time provided by an embodiment of the present disclosure, FIG. 8C is a partial plane schematic diagram of a microfluidic chip at a second time provided by an embodiment of the present disclosure, FIG. 9A is a timing chart of a driving method of the microfluidic chip at a first time provided by an embodiment of the present disclosure, and FIG. 9B is an enlarged schematic diagram of a dashed box portion in FIG. 9A.

For example, as shown in FIGS. 8A and 8B, the plurality of driving circuits further include an initial driving circuit 1210, and the initial driving circuit 1210 is adjacent to the first target driving circuit 1211. The first decoding circuit and the second decoding circuit need to control the liquid droplet 170 to move from the initial driving circuit 1210 to the first target driving circuit 1211. In step S12, controlling the operation of the liquid droplet includes that: at the initial time, the liquid droplet is located over the initial driving circuit; at a first time after the initial time, the first target driving circuit is driven by the first target scan driving signal and the first target driving voltage signal to control the liquid droplet to move from the initial driving circuit to the first target driving circuit.

It should be noted that "adjacent" may mean adjacent in a row direction or a column direction, and also may mean adjacent in a diagonal direction, that is, if a driving circuit is located in a row adjacent to the row where the first target driving circuit 1211 is located and in a column adjacent to the column where the first target driving circuit 1211 is located, the driving circuit is adjacent to the first target driving circuit 1211. For example, if the first target driving circuit 1211 is located in a fourth row and in the fifth column, the driving circuit adjacent to the first target driving circuit 1211 may be located in a third row and in the fourth column, in the third row and in the sixth column, in the fifth row and in the fourth column, or in the fifth row and in the sixth column. As shown in FIG. 8A, the first target driving circuit 1211 is adjacent to the driving circuit 1213, while the initial driving circuit 1210 is not adjacent to the driving circuit 1213.

For example, as shown in FIG. 8A, at the initial time, the liquid droplet 170 is located at the initial driving circuit 1210; and as shown in FIG. 8B, at the first time, the liquid droplet 170 moves to the first target driving circuit 1211.

For example, the first target driving circuit may be located in the fifth row and in the fifth column. As shown in FIG. 9A, firstly, the first trigger signal terminal STV1 outputs a valid first trigger signal to drive the first decoding circuit to start operating, and the plurality of cascaded shift register units of the first decoding circuit sequentially generate and output the plurality of scan driving signals (the scan driving signals $OT_1$ to $OT_N$ as shown in FIG. 7A). Because the first target driving circuit is located in the fifth row, the scan driving signal $OT_5$ corresponding to the fifth row of the driving circuits is the first target scan driving signal, that is, the scan driving signal $OT_5$ can be output to the fifth row of the driving circuit array, while the remaining scan driving signals ($OT_1$ to $OT_4$, $OT_6$ to $OT_N$) cannot be output to the driving circuit array. Thus, in the case where the first decoding circuit generates and outputs the scan driving signal $OT_5$, the scan enable signal output by the scan enable signal interface EG is valid, whereby the scan driving signal OT5 is output to the driving circuit array.

For example, the plurality of data signal interfaces can transmit 10 data signals simultaneously at a time, i.e., P is 10. As shown in FIG. 9B, in the driving period T1, the second trigger signal terminal STV2 outputs a valid second trigger signal to drive the second decoding circuit to start operating. Because the first target driving circuit is located in the fifth column, in a first first sub-period ts11, the first data signal interface R[0] to the (P)-th data signal interface R[P−1] output 10 data signals to the second decoding circuit in parallel. The second decoding circuit processes the 10 data signals to generate 10 driving voltage signals, and the driving voltage signal, which corresponds to the fifth column of the driving circuits, in the 10 driving voltage signals is the first target driving voltage signal, the first target driving voltage signal can be a high voltage signal, and the other driving voltage signals can be low voltage signals. Then, the 10 driving voltage signals are simultaneously transmitted to the 10 column of the driving circuits, respectively, and the first target driving voltage signal is transmitted to the fifth column of the driving circuits. At this time, the transistors of the driving circuits located in the fifth row are all turned on, and therefore, the first target driving voltage signal can be applied to the driving electrode of the driving circuit (i.e., the first target driving circuit) located in the fifth row and in the fifth column. The signal on the driving electrode in the first target driving circuit is a high level signal, while the signal on the driving electrode of the initial driving circuit is, for example, a low level signal, whereby, as shown in FIG. 8B, the liquid droplet 170 moves from the initial driving circuit 1210 to the first target driving circuit 1211 at the first time.

For example, as shown in FIGS. 8A-8C, the initial driving circuit 1210 and the first target driving circuit 1211 are located in the same row, and the initial driving circuit may be located in the fifth row and in the fourth column, for example. But the present disclosure is not limited to this case, the initial driving circuit 1210 and the first target driving circuit 1211 are located in the same column, and the initial driving circuit may be located in the sixth row and in the fifth column, for example. Alternatively, the initial driving circuit 1210 and the first target driving circuit 1211 are located in the same diagonal, and the initial driving circuit 1210 may be located in the fourth row and in the fourth column, for example.

Figure 10A:
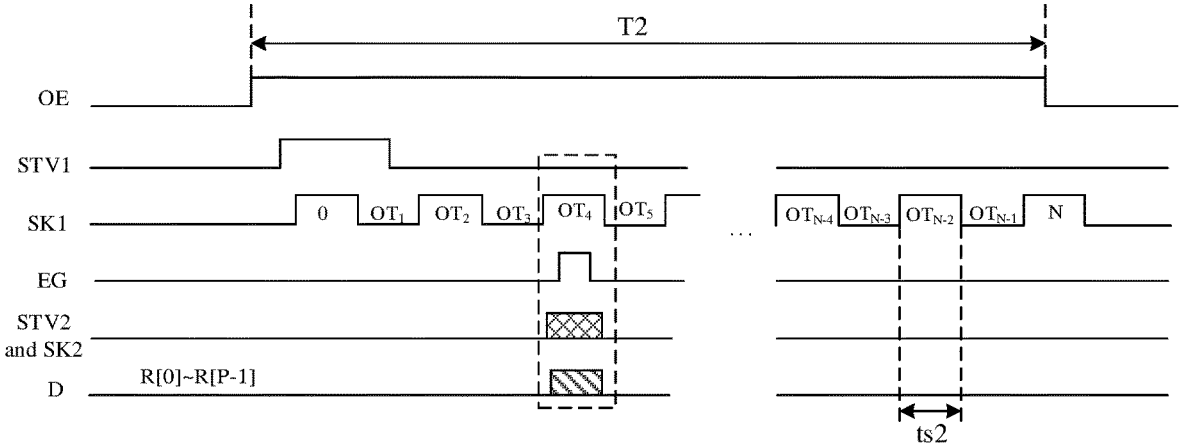
FIG. 10A is a timing chart of a driving method of a microfluidic chip at a second time provided by an embodiment of the present disclosure.
Figure 10B:
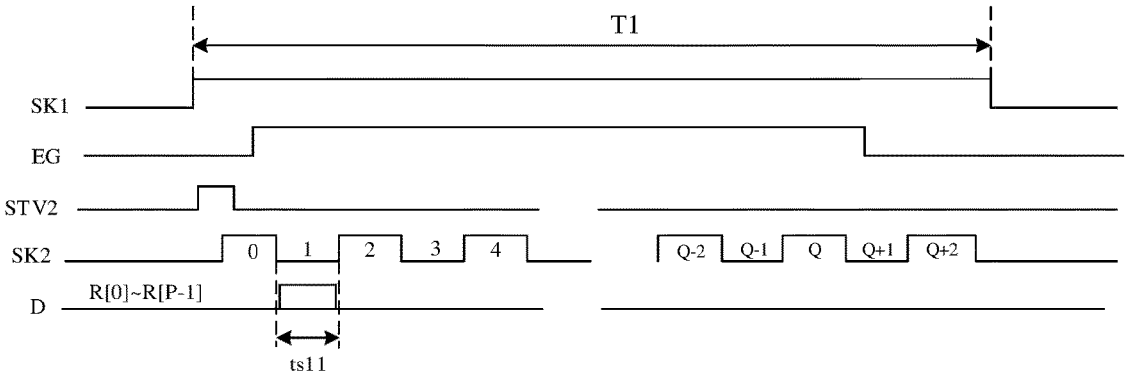
FIG. 10B is an enlarged schematic diagram of a dashed box portion as shown in FIG. 10A.

FIG. 10A is a timing chart of a driving method of a microfluidic chip at a second time provided by an embodiment of the present disclosure, and FIG. 10B is an enlarged schematic diagram of a dashed box portion in FIG. 10A.

For example, in some embodiments, the driving method further includes: determining a second target driving circuit among the plurality of driving circuits; providing a second target scan driving signal for the second target driving circuit; providing a second target driving voltage signal for the second target driving circuit.

For example, in step S12, controlling the operation of the liquid droplet further includes: at a second time after the first time, driving the second target driving circuit through the second target scan driving signal and the second target driving voltage signal to control the liquid droplet to move from the first target driving circuit to the second target driving circuit.

For example, as shown in FIG. 8C, at the second time, the liquid droplet 170 moves from the first target driving circuit 1211 to the second target driving circuit 1212.

For example, the first target driving circuit 1211 may be located in the fifth row and fifth column, and the second target driving circuit 1212 may be located in the fourth row and fifth column. As shown in FIG. 10A, firstly, the first trigger signal terminal STV1 outputs a valid first trigger signal to drive the first decoding circuit to start operating, and the plurality of cascaded shift register units of the first decoding circuit sequentially generate and output the plurality of scan driving signals (the scan driving signals $OT_1$ to $OT_N$ as shown in FIG. 7A). Because the second target driving circuit is located in the fourth row, the scan driving signal $OT_4$ corresponding to the fourth row of the driving circuits is the second target scan driving signal, that is, the scan driving signal $OT_4$ can be output to the fourth row of the driving circuit array, while the remaining scan driving signals ($OT_1$ to $OT_3$, $OT_5$ to $OT_N$) cannot be output to the driving circuit array. Thus, in the case where the first decoding circuit generates and outputs the scan driving signal $OT_4$, the scan enable signal output by the scan enable signal interface EG is valid, whereby the scan driving signal $OT_4$ is output to the driving circuit array.

For example, the plurality of data signal interfaces can transmit 10 data signals simultaneously at a time, i.e., P is 10. As shown in FIG. 10B, in the driving period T1, the second trigger signal terminal STV2 outputs a valid second trigger signal to drive the second decoding circuit to start operating. Because the second target driving circuit is located in the fifth column, in the first first sub-period ts11, the first data signal interface R[0] to the (P)-th data signal interface R[P−1] output 10 data signals to the second decoding circuit in parallel. The second decoding circuit processes the 10 data signals to generate 10 driving voltage signals, and the driving voltage signal, which corresponds to the fifth column of the driving circuits, in the 10 driving voltage signals is the second target driving voltage signal, the second target driving voltage signal can be a high voltage signal, and the other driving voltage signals can be low voltage signals. Then, the 10 driving voltage signals are simultaneously transmitted to the driving electrodes of the 10 columns of the driving circuits, and the second target driving voltage signal is transmitted to the fifth column of the driving circuits. At this time, the transistors of the driving circuits located in the fourth row are all turned on, whereby the second target driving voltage signal can be applied to the driving electrode of the driving circuit (i.e., the second target driving circuit) located in the fourth row and the fifth column. The signal on the driving electrode in the second target driving circuit is a high level signal, while the signal on the driving electrode of the first target driving circuit is, for example, a low level signal, and thus, as shown in FIG. 8C, the liquid droplet 170 can move from the first target driving circuit 1211 to the second target driving circuit 1212.

For example, in some examples, as shown in FIGS. 8A-8C, the first target driving circuit 1211 and the second target driving circuit are located in the same row, i.e., the first decoding circuit and the second decoding circuit can control the liquid droplet to move in the row direction of the driving circuit array. For example, the first target driving circuit 1211 is located in the fifth row and fifth column, and the second target driving circuit is located in the fifth row and sixth column. At this time, the first target scan driving signal and the second target scan driving signal are the same, and both the first target scan driving signal and the second target scan driving signal are the scan driving signal $OT_5$ corresponding to the fifth row of the driving circuits. The first target driving voltage signal is different from the second target driving voltage signal, the first target driving voltage signal is a driving voltage signal corresponding to the fifth column of the driving circuits, and the second target driving voltage signal is a driving voltage signal corresponding to the sixth column of the driving circuits. That is, at the first time, the driving voltage signal corresponding to the fifth column of the driving circuits is a high voltage signal; and at the second time, the driving voltage signal corresponding to the sixth column of the driving circuits is a high voltage signal.

For example, in other examples, the first target driving circuit and the second target driving circuit are located in the same column, that is, the first decoding circuit and the second decoding circuit can control the liquid droplet to move in the column direction of the driving circuit array. For example, the first target driving circuit 1211 is located in the fifth row and fifth column, and the second target driving circuit is located in the fourth row and fifth column. At this time, the first target scan driving signal and the second target scan driving signal are different, and the first target driving voltage signal and the second target driving voltage signal are the same.

It should be noted that in the present disclosure, "the first target scan driving signal and the second target scan driving signal are different" may indicate that the first target scan driving signal and the second target scan driving signal are scan driving signals respectively corresponding to different rows, while a value of the first target scan driving signal and a value of the second target scan driving signal may be the same, for example, both are 3.3V. However, the present disclosure is not limited thereto, and the value of the first target scan driving signal and the value of the second target scan driving signal may also be different. "The first target scan driving signal and the second target scan driving signal are the same" means that the first target scan driving signal and the second target scan driving signal are the scan driving signals corresponding to the same row (e.g., the fifth row). At this time, a value of the first target scan driving signal and a value of the second target scan driving signal may be the same. Similarly, "the first target driving voltage signal and the second target driving voltage signal are different" means that the first target driving voltage signal and the second target driving voltage signal are driving voltage signals respectively corresponding to different columns, and the value of the first target driving voltage signal and the value of the second target driving voltage signal may be the same, for example, both are 30V, but the present disclosure is not limited thereto, and the value of the first target driving voltage signal and the value of the second target driving voltage signal may also be different. "The first target driving voltage signal and the second target driving voltage signal are the same" means that the first target driving voltage signal and the second target driving voltage signal are the driving voltage signals corresponding to the same column (e.g., the fifth column), and at this time, the value of the first target driving voltage signal and the value of the second target driving voltage signal may be the same.

For example, in the case where the liquid droplet is controlled to move in the row direction of the driving circuit array, in each scan period T2, the liquid droplet moves once, that is, the liquid droplet can only move from the first target driving circuit to the second target driving circuit. In the case where the liquid droplet is controlled to move in the column direction of the driving circuit array, the liquid droplet may move only once or multiple times in each scan period T2. For example, the plurality of driving circuits further include a third target driving circuit, and the third target driving circuit is driven by a third target scan driving signal and a third target driving voltage signal. The first target driving circuit is adjacent to the second target driving circuit, and the third target driving circuit is adjacent to the second target driving circuit, that is, the second target driving circuit is located between the first target driving circuit and the third target driving circuit, and the first target driving circuit, the second target driving circuit, and the third target driving circuit are located in the same column. At this time, in each scan period T2, the liquid droplet can move from the first target driving circuit to the second target driving circuit, and then from the second target driving circuit to the third target driving circuit. In one example, the first target driving circuit is located in the fourth row and fifth column, the second target driving circuit is located in the fifth row and fifth column, and the third target driving circuit is located in the sixth row and fifth column. In one scan period T2, the first decoding circuit can sequentially output the first target scan driving signal, the second target scan driving signal, and the third target scan driving signal, the first target scan driving signal is a scan driving signal corresponding to the fourth row of the driving circuits, the second target scan driving signal is a scan driving signal corresponding to the fifth row of the driving circuits, and the third target scan driving signal is a scan driving signal corresponding to the sixth row of the driving circuits; and the second decoding circuit can sequentially output a first target driving voltage signal, a second target driving voltage signal, and a third target driving voltage signal, and the first target driving voltage signal, the second target driving voltage signal, and the third target driving voltage signal are the same and are all driving voltage signals corresponding to the fifth column of the driving circuits.

For example, in some embodiments of the present disclosure, operations, such as splitting and merging, may also be performed on the liquid droplet. The plurality of driving circuits may further include a first initial driving circuit, a fourth target driving circuit, and a fifth target driving circuit, the first initial driving circuit, the fourth target driving circuit, and the fifth target driving circuit are located in the same row or the same column, the fourth target driving circuit is adjacent to the first initial driving circuit, and the fifth target driving circuit is also adjacent to the first initial driving circuit, that is, the first initial driving circuit is located between the fourth target driving circuit and the fifth target driving circuit. In the case where the liquid droplet needs to be split, the liquid droplet is located at the first initial driving circuit at the initial time; at a splitting time after the initial time, voltages can be simultaneously applied to the fourth target driving circuit and the fifth target driving circuit, so that a first portion of the liquid droplet can move from the first initial driving circuit to the fourth target driving circuit and a second portion of the liquid droplet can move from the first initial driving circuit to the fifth target driving circuit, thereby forming two new liquid droplets.

For another example, the plurality of driving circuits may further include a first initial driving circuit, a second initial driving circuit, and a sixth target driving circuit, the first initial driving circuit, the second initial driving circuit, and the sixth target driving circuit are located in the same row or column, the sixth target driving circuit is adjacent to the first initial driving circuit, and the sixth target driving circuit is also adjacent to the second initial driving circuit, that is, the sixth target driving circuit is located between the first initial driving circuit and the second initial driving circuit. In the case where two liquid droplets need to be merged, a first liquid droplet can be located at the first initial driving circuit and a second liquid droplet can be located at the second initial driving circuit at the initial time, then at a merging time after the initial time, a voltage can be applied to the sixth target driving circuit, so that the first liquid droplet can move from the first initial driving circuit to the sixth target driving circuit, while the second liquid droplet can move from the second initial driving circuit to the sixth target driving circuit, and the first liquid droplet and the second liquid droplet merge into a new liquid droplet at the sixth target driving circuit.

It should be noted that the timing chart for driving the microfluidic chip can be designed according to the actual application, and the present disclosure is not limited to this case here.

For the present disclosure, the following points need to be explained:

(1) The drawings of the embodiments of the present disclosure only refer to the structures related to the embodiments of the present disclosure, and other structures may refer to the general design.

(2) In case of no conflict, the embodiments of the present disclosure and the features in the embodiments can be combined with each other to obtain new embodiments.

What have been described above merely are specific implementations of the present disclosure, but the protection scope of the present disclosure is not limited to this. The protection scope of the present disclosure is determined by the appended claims.

What is claimed is:

1. A microfluidic chip, comprising: a base substrate, a driving circuit array, a first decoding circuit, and a second decoding circuit, wherein the driving circuit array, the first decoding circuit, and the second decoding circuit are all integrated on the base substrate;

the first decoding circuit is configured to generate and output a target scan driving signal to the driving circuit array;

the second decoding circuit is configured to generate and output a target driving voltage signal to the driving circuit array;

the driving circuit array comprises a plurality of driving circuits and is configured to control an operation of a liquid droplet over the driving circuit array based on the target scan driving signal and the target driving voltage signal; and a first terminal of each of the plurality of driving circuits is coupled to the first decoding circuit, and a second terminal of each of the plurality of driving circuits is coupled to the second decoding circuit, wherein each of the plurality of driving circuits comprises a transistor and a driving electrode, the first terminal of each of the plurality of driving circuits comprises a gate electrode of the transistor, the second terminal of each of the plurality of driving circuits comprises a first electrode of the transistor, and in each of the plurality of driving circuits, a second electrode of the transistor is connected to the driving electrode.

2. The microfluidic chip according to claim 1, wherein in each of the plurality of driving circuits, an orthographic projection of the transistor on the base substrate and an orthographic projection of the driving electrode on the base substrate at least partially overlap.

3. The microfluidic chip according to claim 1, further comprising a plurality of first signal lines and a plurality of second signal lines, wherein the plurality of driving circuits in the driving circuit array are arranged in an array of a plurality of rows and a plurality of columns, the first terminals of driving circuits in a same row of the plurality of driving circuits are coupled to the first decoding circuit through a same first signal line in the plurality of first signal lines; and the second terminals of driving circuits in a same column of the plurality of driving circuits are coupled to the second decoding circuit through a same second signal line in the plurality of second signal lines.

4. The microfluidic chip according to claim 3, wherein the plurality of first signal lines are in one-to-one correspondence to the plurality of rows of the plurality of driving circuits in the driving circuit array, and the plurality of second signal lines are in one-to-one correspondence to the plurality of columns of the plurality of driving circuits in the driving circuit array.

5. The microfluidic chip according to claim 1, wherein the first decoding circuit comprises a plurality of cascaded shift register units, the plurality of cascaded shift register units are configured to output a plurality of scan driving signals, and the plurality of scan driving signals comprise the target scan driving signal.

6. The microfluidic chip according to claim 5, wherein the base substrate comprises an intermediate region and a peripheral region surrounding the intermediate region, the driving circuit array is integrated in the intermediate region, and the first decoding circuit and the second decoding circuit are integrated in the peripheral region.

7. The microfluidic chip according to claim 6, further comprising a signal input circuit, wherein the signal input circuit is integrated in the peripheral region and is coupled to the first decoding circuit and the second decoding circuit; and the signal input circuit comprises a plurality of power supply interfaces, a plurality of control signal interfaces, and a plurality of data signal interfaces.

8. The microfluidic chip according to claim 7, wherein the plurality of control signal interfaces comprise a scan clock signal interface, and output clock signal terminals of the plurality of cascaded shift register units are coupled to the scan clock signal interface.

9. The microfluidic chip according to claim 8, wherein the first decoding circuit further comprises an inverting sub-circuit, an output clock signal terminal of a (2L-1)-th stage shift register unit is coupled to the scan clock signal interface, and an output clock signal terminal of a (2L)-th stage shift register unit is coupled to the scan clock signal interface through the inverting sub-circuit, or the output clock signal terminal of the (2L-1)-th stage shift register unit is coupled to the scan clock signal interface through the inverting sub-circuit, the output clock signal terminal of the (2L)-th stage shift register unit is coupled to the scan clock signal interface; and L is an integer greater than 0.

10. The microfluidic chip according to claim 7, wherein the plurality of control signal interfaces further comprise a scan enable signal interface, and the first decoding circuit further comprises a scan output control sub-circuit, the scan output control sub-circuit is coupled to the scan enable signal interface and is configured to receive the plurality of scan driving signals and output the target scan driving signal of the plurality of scan driving signals to the driving circuit array under control of the scan enable signal interface.

11. The microfluidic chip according to claim 7, wherein the plurality of data signal interfaces are configured to receive a plurality of data signals, the second decoding circuit is coupled to the plurality of data signal interfaces, and is configured to receive the plurality of data signals and generate the target driving voltage signal according to the plurality of data signals.

12. The microfluidic chip according to claim 11, wherein the second decoding circuit comprises M output channels and a multiplexing circuit, and the plurality of driving circuits are arranged in an array of M columns, the M output channels respectively correspond to the M columns of the plurality of driving circuits for outputting the target driving voltage signal, and the multiplexing circuit is coupled to the plurality of data signal interfaces to receive the plurality of data signals.

13. The microfluidic chip according to claim 12, wherein the second decoding circuit further comprises a voltage amplification sub-circuit, the voltage amplification sub-circuit is coupled to the M output channels and the multiplexing circuit, the multiplexing circuit is configured to apply the plurality of data signals to the voltage amplification sub-circuit, and the voltage amplification sub-circuit is configured to receive and amplify the plurality of data signals, determine the target driving voltage signal according to the plurality of data signals which are amplified, and output the target driving voltage signal to an output channel, which corresponds to the target driving voltage signal, among the M output channels.

14. A driving method of a microfluidic chip, wherein the microfluidic chip comprises: a base substrate, a driving circuit array, a first decoding circuit, and a second decoding circuit, the driving circuit array, the first decoding circuit, and the second decoding circuit are all integrated on the base substrate;

the first decoding circuit is configured to generate and output a target scan driving signal to the driving circuit array;

the second decoding circuit is configured to generate and output a target driving voltage signal to the driving circuit array;

the driving circuit array comprises a plurality of driving circuits and is configured to control an operation of a liquid droplet over the driving circuit array based on the target scan driving signal and the target driving voltage signal, a first terminal of each of the plurality of driving circuits is coupled to the first decoding circuit, and a second terminal of each of the plurality of driving circuits is coupled to the second decoding circuit, wherein each of the plurality of driving circuits comprises a transistor and a driving electrode, the first terminal of each of the plurality of driving circuits comprises a gate electrode of the transistor, the second terminal of each of the plurality of driving circuits comprises a first electrode of the transistor, and in each of the plurality of driving circuits, a second electrode of the transistor is connected to the driving electrode; and the driving method comprises:

determining a first target driving circuit among the plurality of driving circuits;

providing a first target scan driving signal for the first target driving circuit; and providing a first target driving voltage signal for the first target driving circuit, wherein the first target driving circuit is driven by the first target scan driving signal and the first target driving voltage signal to control the operation of the liquid droplet.

15. The driving method according to claim 14, wherein the plurality of driving circuits further comprise an initial driving circuit, the initial driving circuit is adjacent to the first target driving circuit, controlling the operation of the liquid droplet comprises:

at an initial time, the liquid droplet being located over the initial driving circuit; and at a first time after the initial time, driving the first target driving circuit by the first target scan driving signal and the first target driving voltage signal to control the liquid droplet to move from the initial driving circuit to the first target driving circuit.

16. The driving method according to claim 15, further comprising:

determining a second target driving circuit among the plurality of driving circuits;

providing a second target scan driving signal for the second target driving circuit; and providing a second target driving voltage signal for the second target driving circuit, wherein the first target driving circuit is adjacent to the second target driving circuit, and controlling the operation of the liquid droplet further comprises:

at a second time after the first time, driving the second target driving circuit by the second target scan driving signal and the second target driving voltage signal to control the liquid droplet to move from the first target driving circuit to the second target driving circuit.

17. The driving method according to claim 16, wherein the first target driving circuit and the second target driving circuit are located in a same row, the first target scan driving signal is identical to the second target scan driving signal, and the first target driving voltage signal is different from the second target driving voltage signal.

18. The driving method according to claim 16, wherein the first target driving circuit and the second target driving circuit are located in a same column, the first target scan driving signal is different from the second target scan driving signal, and the first target driving voltage signal is identical to the second target driving voltage signal.

19. The microfluidic chip according to claim 2, further comprising a plurality of first signal lines and a plurality of second signal lines, wherein the plurality of driving circuits in the driving circuit array are arranged in an array of a plurality of rows and a plurality of columns, the first terminals of driving circuits in a same row of the plurality of driving circuits are coupled to the first decoding circuit through a same first signal line in the plurality of first signal lines; and the second terminals of driving circuits in a same column of the plurality of driving circuits are coupled to the second decoding circuit through a same second signal line in the plurality of second signal lines.

* * * * *